US011524420B2

(12) United States Patent
Haley

(10) Patent No.: US 11,524,420 B2
(45) Date of Patent: Dec. 13, 2022

(54) RAZOR

(71) Applicant: BRENGOR INNOVATION LTD, South Milford (GB)

(72) Inventor: Christopher Darren Haley, South Milford (GB)

(73) Assignee: Brengor Innovation Ltd, South Milford (GB)

( * ) Notice: Subject to any disclaimer, the term of this patent is extended or adjusted under 35 U.S.C. 154(b) by 0 days.

(21) Appl. No.: 17/266,409

(22) PCT Filed: Dec. 6, 2019

(86) PCT No.: PCT/IB2019/060523
§ 371 (c)(1),
(2) Date: Feb. 5, 2021

(87) PCT Pub. No.: WO2020/128706
PCT Pub. Date: Jun. 25, 2020

(65) Prior Publication Data

US 2021/0291394 A1 Sep. 23, 2021

(30) Foreign Application Priority Data

Dec. 21, 2018 (GB) ..... 1820916

(51) Int. Cl.
*B26B 21/56* (2006.01)
*B26B 21/58* (2006.01)

(52) U.S. Cl.
CPC ..... *B26B 21/56* (2013.01); *B26B 21/58* (2013.01)

(58) Field of Classification Search
CPC ..... B26B 21/00; B26B 21/18; B26B 21/20; B26B 21/22; B26B 21/32; B26B 21/4006; B26B 21/54; B26B 21/56; B26B 21/58; B26B 19/12; B26B 19/14; B26B 19/143; B26B 19/384
USPC ..... 30/47–51, 346.61, 351
See application file for complete search history.

(56) References Cited

U.S. PATENT DOCUMENTS 2,439,909 A * 4/1948 Rushin ..... B26B 21/56 30/51
2,614,321 A 10/1952 Ackerman
2,877,548 A * 3/1959 Starre ..... B26B 19/384 30/346.51
2,989,804 A 6/1961 Yellon
3,052,023 A * 9/1962 Meohas ..... B26B 21/06 30/53
3,702,026 A 11/1972 Scholin
3,805,387 A 4/1974 Siegmund et al.
(Continued)

FOREIGN PATENT DOCUMENTS

EP 0039567 B1 6/1985
EP 0276066 A1 7/1988
(Continued)

*Primary Examiner* — Jason Daniel Prone
(74) *Attorney, Agent, or Firm* — Woods, Phillips, Katz, Clark & Mortimer

(57) ABSTRACT

A razor has a rigid metal body member with a thickness and a plurality of apertures therein. The rigid metal body member has a skin-engaging surface. Each aperture has a cutting blade adjacent the skin-engaging surface. The thickness of the rigid metal body member is from 2 mm to 10 mm.

12 Claims, 6 Drawing Sheets

(56) References Cited

U.S. PATENT DOCUMENTS 4,133,103 A * 1/1979 Beck ..... B26B 19/20 30/346.51
4,483,068 A 11/1984 Clifford
4,603,477 A * 8/1986 Francis ..... B26B 21/56 30/50
4,807,360 A * 2/1989 Cerier ..... B26B 21/56 30/49
4,875,288 A * 10/1989 Trotta ..... B26B 21/56 30/50
4,964,214 A * 10/1990 Welsh ..... B26B 21/56 30/49
4,977,670 A 12/1990 Iten
4,979,298 A * 12/1990 Pesiri ..... B26B 21/56 30/49
4,984,365 A 1/1991 Leonard et al.
5,018,274 A 5/1991 Trotta
5,031,318 A * 7/1991 Brown ..... B26B 21/4081 30/49
5,088,195 A * 2/1992 Lazarshik ..... B26B 19/384 30/49
5,153,992 A * 10/1992 Brown ..... B26B 21/56 30/49
5,490,329 A * 2/1996 Chylinski ..... B26B 21/20 30/49
5,604,983 A 2/1997 Simms et al.
5,983,756 A * 11/1999 Orloff ..... B26B 21/20 76/DIG. 8
6,161,287 A 12/2000 Swanson et al.
6,185,823 B1 2/2001 Brown et al.
6,315,224 B1 * 11/2001 Holcomb ..... A47J 43/25 241/273.3
7,007,393 B2 * 3/2006 Guimont ..... B26B 21/4006 30/346.5
7,124,511 B2 * 10/2006 Hamada ..... B26B 21/58 30/346.53
7,357,052 B2 * 4/2008 Denne ..... B26B 21/56 30/346.54
7,730,621 B2 * 6/2010 Komori ..... B26B 19/384 30/346.51
8,327,545 B2 * 12/2012 Peterson ..... B26B 21/565 30/50
2002/0066186 A1 * 6/2002 White ..... B26B 21/14 30/50
2004/0118250 A1 6/2004 White et al.
2004/0177517 A1 * 9/2004 Balistee ..... B26B 21/54 30/346.57
2004/0187644 A1 * 9/2004 Peterlin ..... B26B 21/4006 30/346.57
2006/0156555 A1 7/2006 Janny et al.
2006/0272460 A1 * 12/2006 Li ..... B26B 21/20 30/32
2012/0192429 A1 * 8/2012 Savarese ..... B26B 21/4006 30/41
2013/0283624 A1 * 10/2013 Scimone ..... B26B 21/56 30/346.55
2018/0264669 A1 9/2018 Howell
2020/0238549 A1 * 7/2020 Abramsky ..... B26B 19/3846
2022/0168912 A1 * 6/2022 Abramsky ..... B26B 21/4006

FOREIGN PATENT DOCUMENTS

EP 0305866 A2 3/1989
EP 0305883 A2 3/1989
EP 0436693 2/1994
EP 0524194 B1 7/1994
EP 0523170 B1 1/1996
EP 0527770 B1 5/1998
EP 0755318 A4 5/1998
EP 1413407 A1 4/2004
EP 2165809 A1 3/2010
EP 1545841 B1 12/2010
GB 2083398 A 3/1982
GB 2110149 A * 6/1983 ..... B26B 21/56
GB 2593407 A * 9/2021 ..... B26B 21/56
JP H04361783 A 12/1992
JP 2008132003 A 6/2008
WO 95/28259 A1 10/1995
WO 02098619 A1 12/2002
WO 2008065949 A1 6/2008

* cited by examiner

RAZOR

BACKGROUND OF THE INVENTION

Field of the Invention

This invention relates to a shaving razor, and in particular a harm reduction razor that minimizes the risk of adaptation and possibility of misuse.

Background Art

Most conventional razors comprise one or more elongate blade edges fixed in a base. Such razors are generally safe to use under normal conditions. That is, they are designed to remove facial or body hair, while reducing the chances of cutting the user's skin during the shaving operation.

However, such razors are able to be dismantled, or otherwise broken apart to expose the sharp blade. Sadly, there are vulnerable sectors of the population, such as those in prison or in mental institutions, who may attempt to use an extracted blade or other sharp edges from a razor to harm themselves, harm others, or even commit suicide. Although there are no simple answers as to why individuals wish to self-harm, there is a need to attempt to prevent such injuries or deaths.

Razor heads are known that have a plurality of sharp-edged apertures over the surface to provide the cutting edges. For example, EP 2165809 discloses a razor blade comprising a metallic foil sheet with a plurality of apertures, the perimeter of each aperture forming a cutting edge. Such a razor is safe under normal usage conditions, but is not tamper-resistant, because the foil sheet is flexible and could be readily distorted to expose the sharpened cutting edges. Similar blades which comprise thin foils with apertures are also described in EP 0527770, EP 0755318, EP 0436693 and U.S. Pat. No. 4,984,365.

Another type of razor having multiple sharpened apertures is exemplified by EP 0305866, which describes an elastomeric pad in which the apertures are situated. The pad which surrounds and supports the apertures is designed to be readily deformable to conform to the skin surface. Thus again, such a razor, although suitable for its intended purpose of providing a smooth and efficient shaving action, is not useful as a tamper-resistant razor, as its deformability allows access to the blades if misused. Similar razors having flexible or sponge-like supports for apertures are also described in EP 0276066, U.S. Pat. No. 4,977,670, and EP 0524194.

The prior art patent documents described above do not suggest a razor having rigid metal structure containing apertures which can satisfy the need for a harm reduction razor.

SUMMARY OF THE INVENTION

The invention is directed to a razor with a rigid metal body member having a thickness and a plurality of apertures therein. The rigid metal body member has a skin-engaging surface. Each aperture has a cutting blade adjacent the skin-engaging surface. The thickness of the rigid metal body member is from 2 mm to 10 mm.

In one aspect of the invention, the rigid metal body member is made of titanium or steel.

In one aspect of the invention, the rigid metal body member is made of stainless steel.

In one aspect of the invention, the thickness of the rigid metal body member is from 2 mm to 4 mm.

In one aspect of the invention, the apertures are circular in cross-section.

In one aspect of the invention, the apertures each has an axis positioned perpendicular to the skin-engaging surface.

In one aspect of the invention, the apertures each has an axis positioned at an angle of from 50° to 70° to the skin-engaging surface.

In one aspect of the invention, a distance from the cutting blade to an opposite side of an internal body of the apertures is from 0.4 mm to 0.9 mm.

In one aspect of the invention, the distance from the cutting blade to an opposite edge of an upper area of the apertures adjacent the skin-engaging surface is from 0.8 mm to 1.5 mm.

In one aspect of the invention, the rigid metal body member contains from 60 to 250 apertures.

In one aspect of the invention, the apertures are formed in a plurality of rows in the rigid metal body member. Alternate rows of apertures in the rigid metal body member are offset from each other.

In one aspect of the invention, the rigid metal body member is attached to a handle.

The invention is directed generally to a harm reduction razor, as described herein, that minimizes the possibility of misuse, such as being used for self-harm or suicide, and is in the form of a tamper resistant rigid metallic structure with a plurality of apertures having blades within the apertures. The dimensions and shape of the apertures in the metal body member are sufficient to allow protruding facial or bodily hairs to enter the aperture, but prevent the skin from entering the aperture so that the cutting blade does not injure the skin. In addition, the body member of the razor cannot readily be bent or distorted without specialist tools, so that the cutting blades cannot be exposed to inflict harm.

BRIEF DESCRIPTION OF THE DRAWINGS

Embodiments of the present invention will now be described with reference to the accompanying drawings in which.

DETAILED DESCRIPTION OF THE PREFERRED EMBODIMENT

Figure 1:
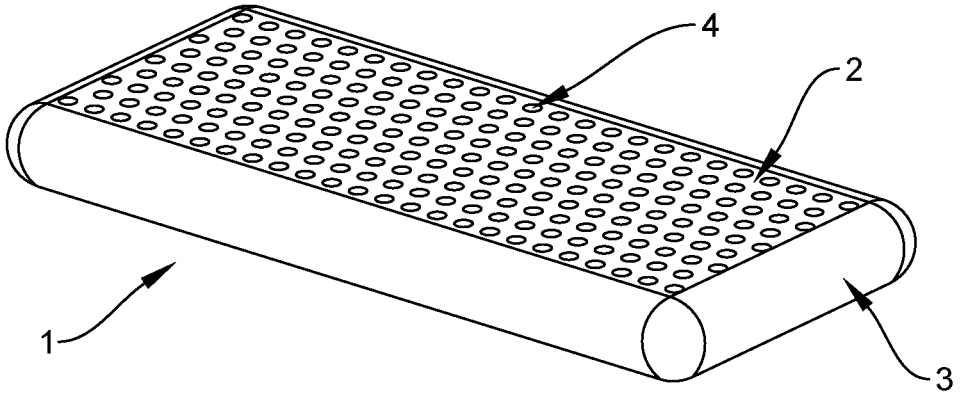
FIG. 1 is a perspective representation of one embodiment of a razor of the present invention.

Referring to FIG. 1, a body member 1 of the razor has a rectangular shape, with a skin-engaging surface 2 uppermost. The body member 1 is constructed from metal, such as titanium or steel, such as stainless steel, and measures approximately 36 mm in length and approximately 13.5 mm in width. It has a rounded perimeter 3, to ensure there are no sharp or rough edges that could cause injury. The body member 1 contains apertures 4, situated in nine rows. Each aperture 4 has a circular cross-section, that is, it forms a cylinder with an axis within the body member 1, with the axes perpendicular to the plane of the skin-engaging surface 2. Each alternate row of apertures is offset so that one row contains 24 apertures and the next row contains 23 apertures, making a total of 212 apertures. Each aperture 4 has a sharpened edge, forming a blade adjacent the skin-engaging surface 2.

Figure 2A:
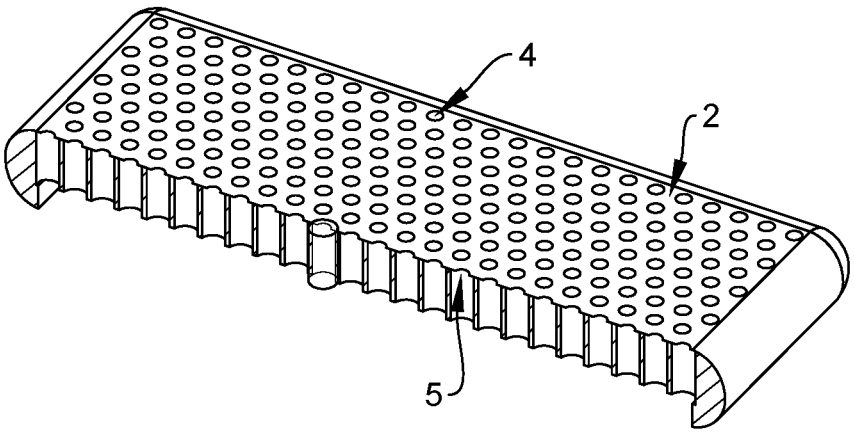
FIG. 2*a* is a cross-section through the body member of the razor of FIG. 1 showing the inside of the apertures therein.

FIG. 2*a* is a cross-section through one row of apertures, showing the internal cylindrical shape of each aperture 4. The depth of each aperture is 3.5 mm. The cutting blade 5 of each aperture is formed at the upper edge of the cylinder adjacent the skin-engaging surface 2. The cutting blades are formed as the apertures are drilled in the body member 1.

Figure 2B:
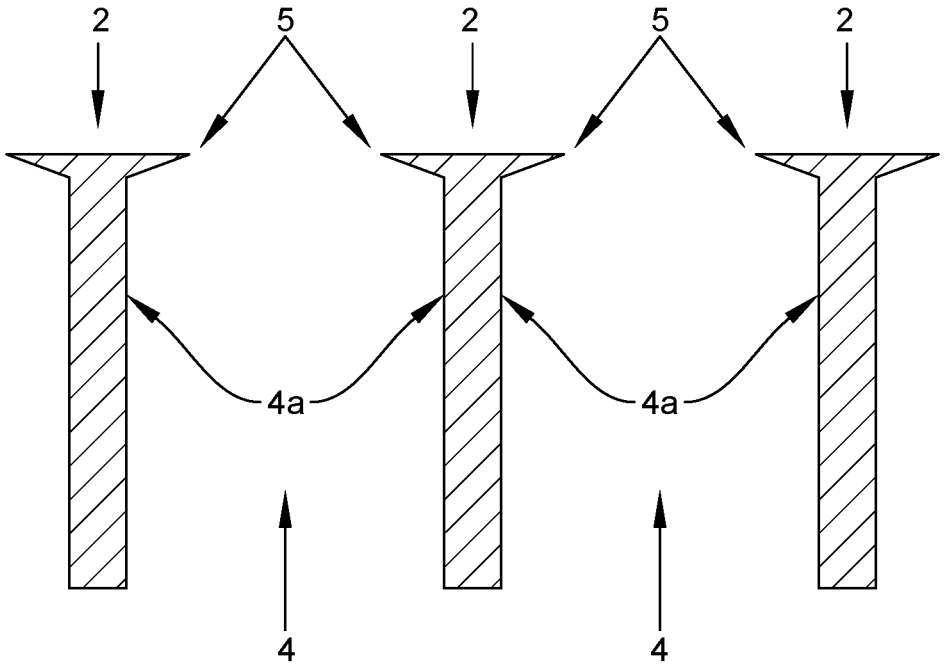
FIG. 2*b* is an expanded cross-section through two of the apertures of FIG. 2*a;*

FIG. 2*b* shows, in cross-section, two of the apertures 4, having main aperture walls 4*a*. Each aperture is formed by drilling; the drill breaks through into the skin-engaging surface 2, but does not complete its progress through the surface 2, thus forming the sharp cutting edge 5, which are integral with the walls 4*a* of the aperture 4.

Figure 3:
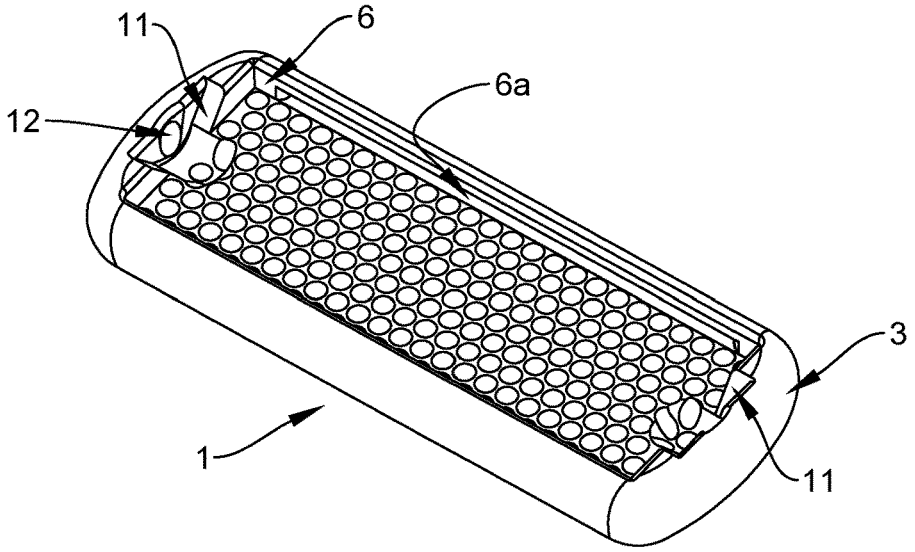
FIG. 3 is a view of the underside of the body member of FIG. 1.

FIG. 3 shows the surface of the body member opposite to the skin-engaging surface of the body member. A recess 6 is provided on the internal edge of the body member 1, that is opposite to the outer rounded perimeter 3, to allow the cut hair to be rinsed away between the body member and the handle of the razor. The recess 6 has a cut-out portion 6*a*, to assist in holding the body member in position during the drilling of the apertures.

The recess 6 also contains lateral slots 11 and sockets 12 to allow the body member 1 to be attached to a handle.

Figure 4:
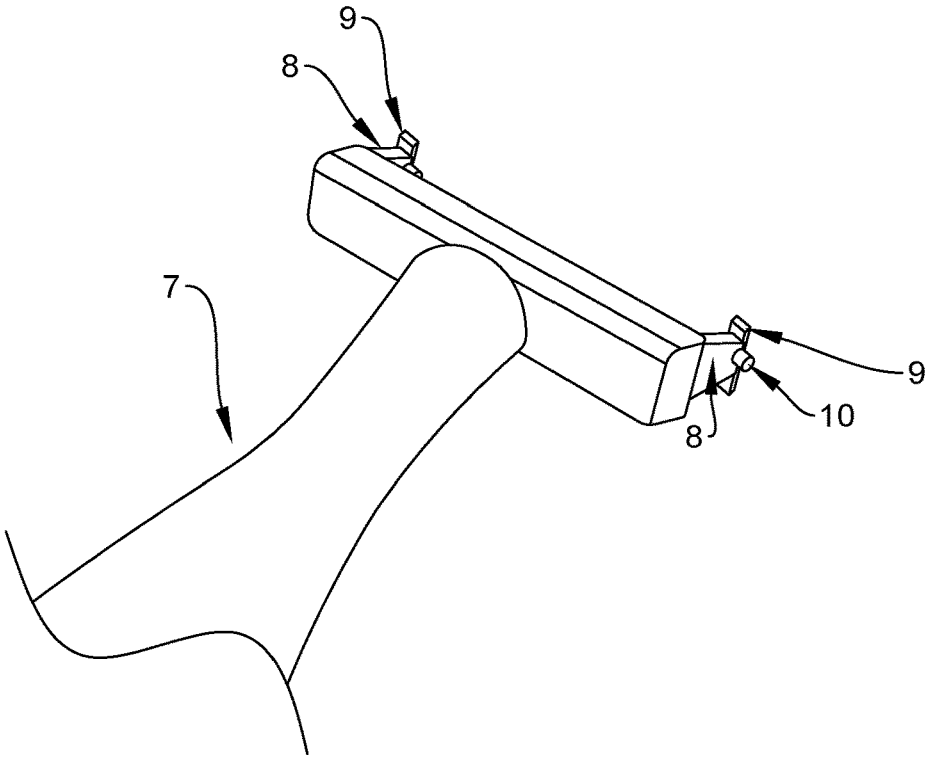
FIG. 4 shows a handle which may be attached to the razor.

FIG. 4 shows a handle adapted to clip onto the body member of the razor of this invention. The handle 7 is provided, at its head, with two resilient clips 8. Each clip 8 is provided with a lateral tab 9 and a cylindrical protrusion 10 which fit into lateral slots 11 and sockets 12 respectively in the body member 1, as shown in FIG. 3. To fit the razor body member 1 onto the handle, the clips 8 are manually squeezed inwardly and the lateral tabs 9 are moved into the slots 11, so that the protrusions 10 clip into the sockets 12. The lateral slots 11 have sloping internal edges, to allow some rotation of the lateral tabs 9 within the slots 11. Hence the razor body member 1 can pivot with respect to the handle 7 during use. The attachment of the handle leaves a gap between the handle and the razor, to enable the cut hair to be rinsed away. The body member 1 may also be removed from the handle to allow cleaning or replacement, without exposing any cutting blades of the razor.

In use, the razor may be pulled across the skin in any direction, because the cutting blades are circular. As the razer is moved across the skin, hairs enter an aperture and are sliced off by the cutting blades 5. The positioning of the tabs 9 within the slots 11 assists in keeping the skin-engaging surface 2 parallel to the facial or body contours. If hairs are missed by one row of cutting blades, the offset rows of apertures ensure that they will be captured by the next row. Thus, a smooth and efficient shaving process is ensured.

A further embodiment of a razor of this invention is depicted in FIGS. 5 to 8. In this embodiment, the apertures are not perpendicular to the skin-engaging surface.

Figure 5:
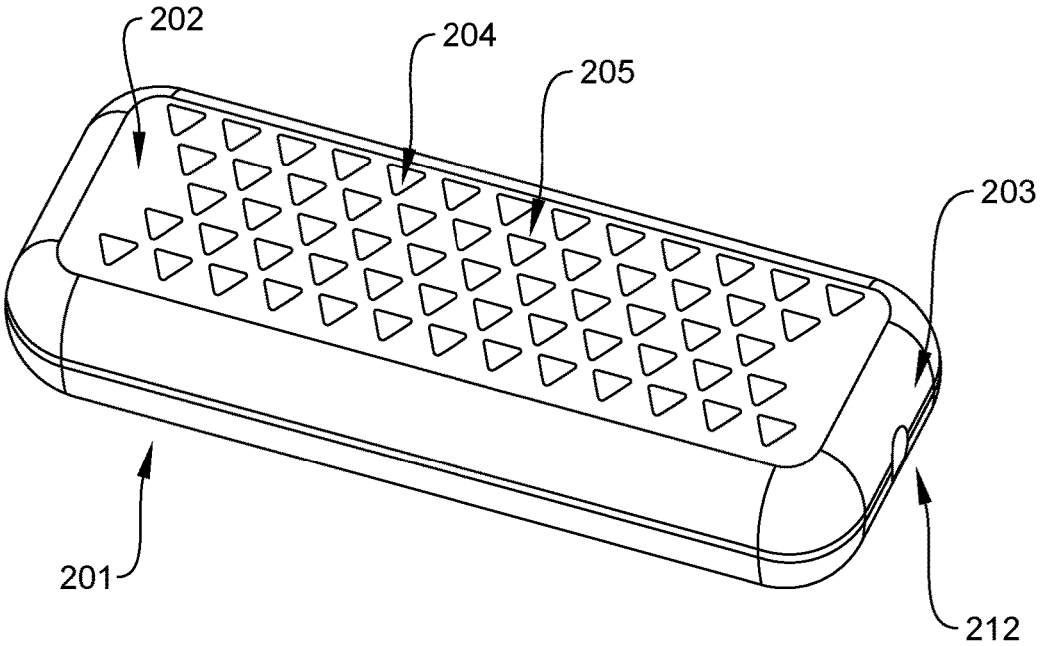
FIG. 5 is a perspective representation of a second embodiment of a razor of this invention.

Referring to FIG. 5, a body member 201 measures approximately 32 mm in length and 13 mm in width. It has a skin-engaging surface 202 and a rounded perimeter 203. The perimeter accommodates a socket 212 for attaching to a handle. The body member 201 contains a plurality of apertures 204, each of which has a circular cross-section, with the axes of the apertures 204 aligned at 50°-70° to the plane of the skin-engaging surface. The apertures terminate in a lip, angled at 20° to the skin-engaging surface, forming cutting blades 205, adjacent the skin-engaging surface 202. The edge of each aperture 204, opposite to the cutting blade 205, has a cavity, which gives the top of each aperture a triangular shape.

Figure 6A:
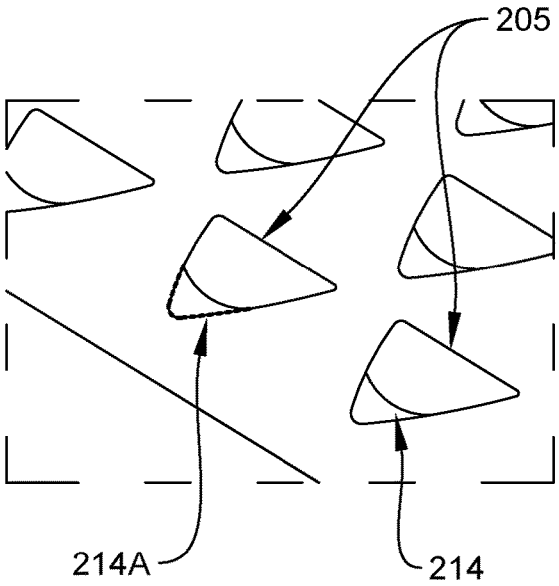
FIGS. 6A and 6B show the apertures of FIG. 5 in more detail.
Figure 6B:
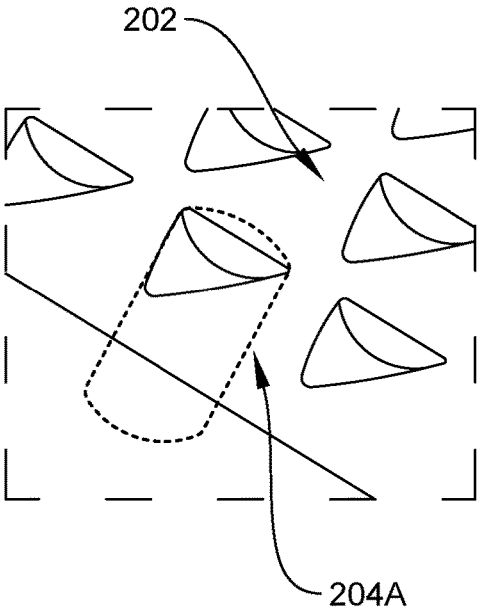

FIGS. 6A and 6B are enlarged representations of the apertures. In FIG. 6A, opposite the cutting blade 205, there is a cavity 214, the outline of which is shown by the dotted line 214A. In FIG. 6B, the dotted line 204A represents the outline of the shape of an aperture, showing its position at an angle to the skin-engaging surface 202.

Figure 7:
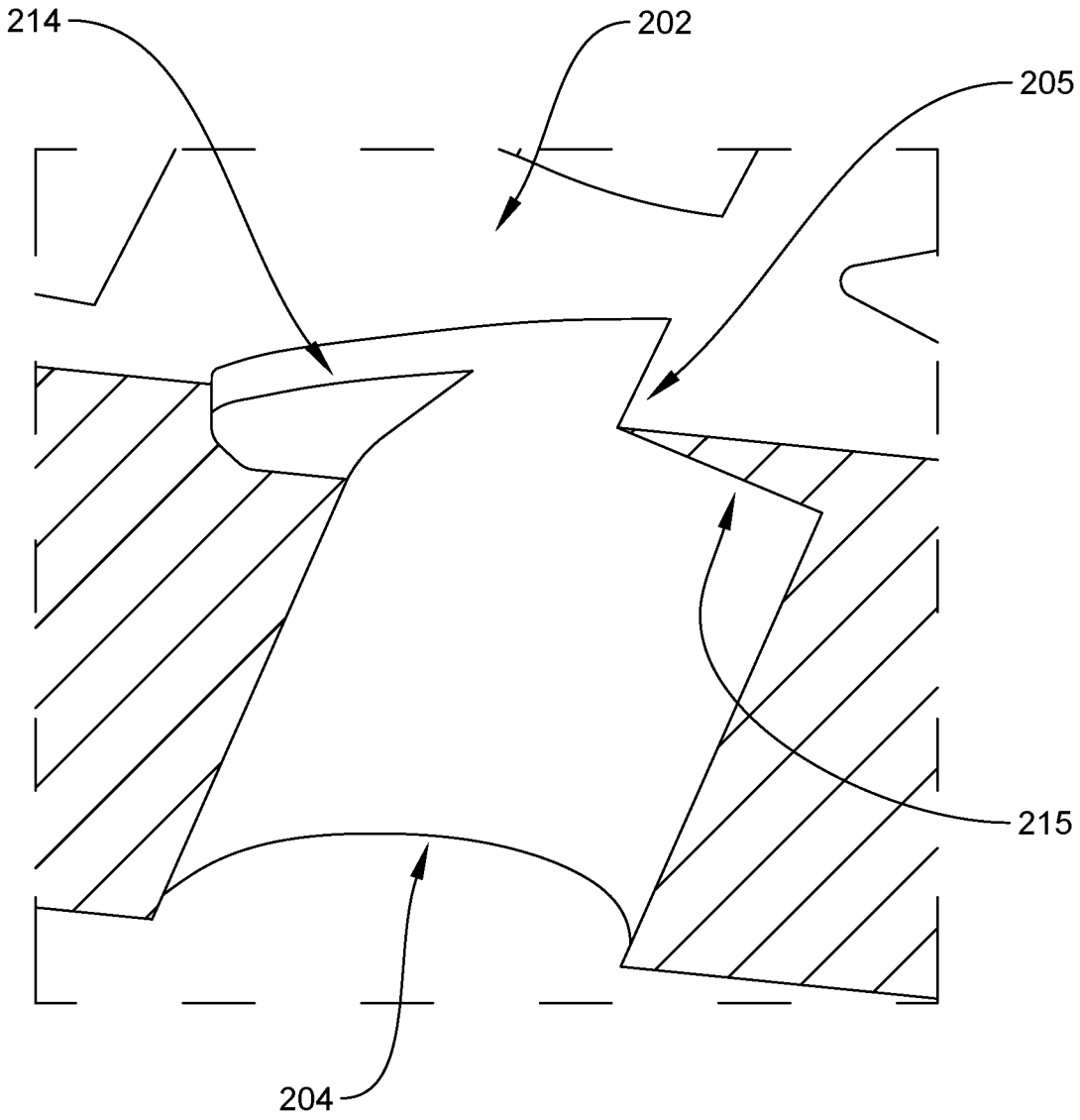
FIG. 7 is a cross-section of one aperture of FIG. 5.

The structure of the apertures is shown in more detail in FIG. 7, which is a cross-sectional view through one of the apertures. An aperture 204 is drilled into the body of the razor, from the underside of the body, at an angle of 60° to the skin-engaging surface 202. The drilling is terminated shortly before it completely cuts through the surface 202, thus forming a lip 215 at an angle of 30° to the surface 202. The end of the lip forms a cutting blade 205, adjacent the skin-engaging surface 202. The body of the razor is then milled at the edge of the aperture opposite to the cutting blade 205, to cut out a cavity 214, which enlarges the upper area of the aperture 204.

Figure 8:
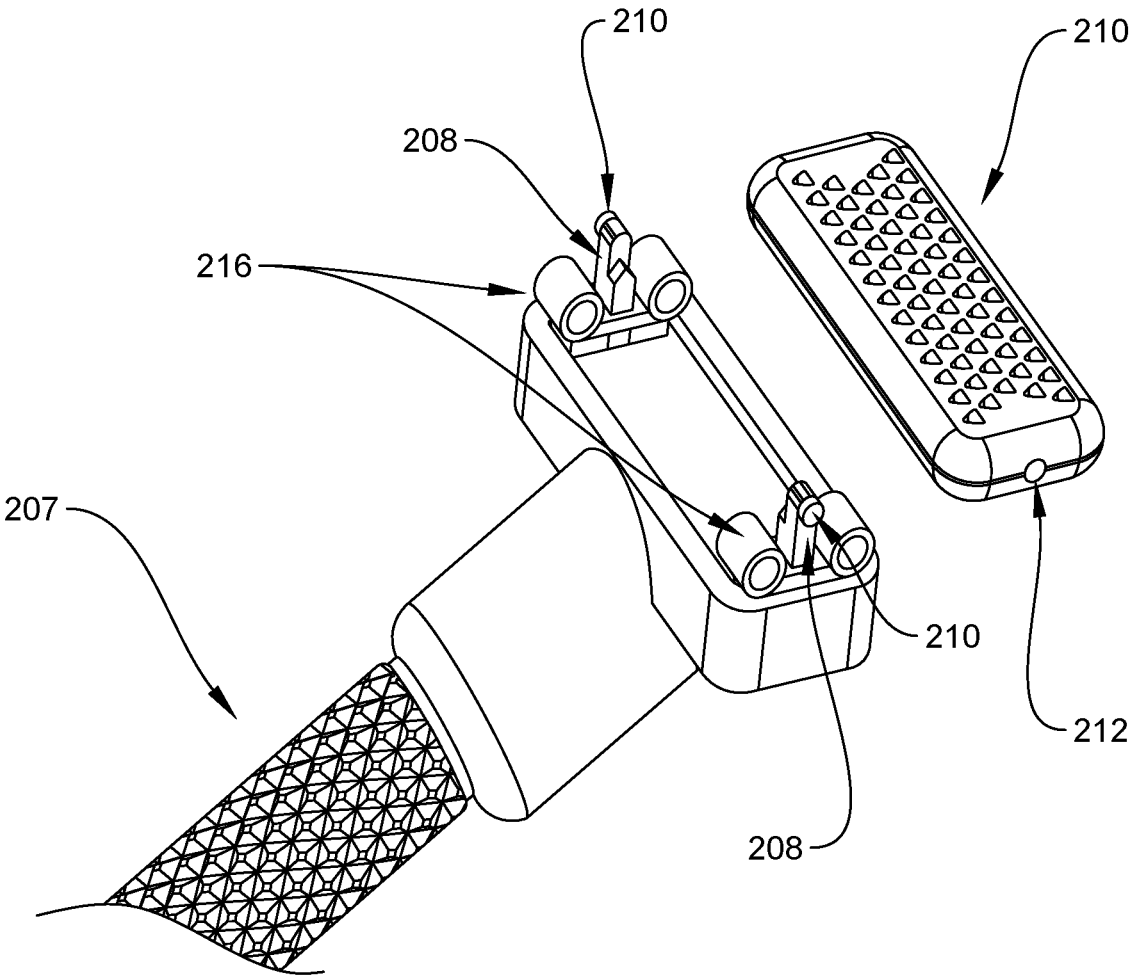
FIG. 8 shows the fitting of a handle to the razor of FIG. 5.

FIG. 8 shows a handle adapted to clip onto the body member of the razor depicted in FIG. 5. The handle 207 is provided, at its head, with two resilient clips 208. Each clip 208 is provided with a cylindrical protrusion 210 which fit into sockets 212 in the body member 201. To fit the razor body member 201 onto the handle, the clips 208 are manually squeezed inwardly, and fitted to the underside of the body member 201, so that the protrusions 210 clip into the sockets 212. The body member 201 rests on rounded supports 216, leaving a gap between the handle and the razor, to enable the cut hair to be rinsed away.

In operation, the razor is moved across the skin and hairs enter an aperture. The cavity 214 assists the hair follicle to enter the aperture and helps to present the base of the follicle to the cutting blade 205, thus increasing the effectiveness and closeness of the shaving process.

In accordance with the object of this invention, after use of the razor shown in these embodiments, it is not readily possible, without tools, to bend, distort or break the razor in a way that will expose the cutting blades. The razor minimizes the risk of adaptation and therefore reduces the possibility of misuse compared to a conventional razor. Thus, the potential for harm is reduced.

Accordingly, the present invention provides a razor comprising a rigid metal body member having a plurality of apertures therein, the body member having a skin-engaging surface, wherein each aperture has a cutting blade adjacent the skin-engaging surface.

The body member is sufficiently rigid to prevent the razor from being readily bent or distorted, without specialist tools. Thus, the metal should not be brittle. Suitable metal materials from which the body member may be constructed include titanium or rigid metal alloys such as steel, preferably stainless steel.

The length and width of the body member of this invention may be about the same size as the head of a conventional razor. The thickness of the razor body member should be sufficient maintain to rigidity. A suitable thickness is from 2 mm to 10 mm, for example 2 mm to 5 mm, preferably from 2 mm to 4 mm, especially about 3 mm or 3.5 mm.

The cutting blade is formed within each aperture and is preferably integral with the walls of the aperture. Thus, the width of the aperture at the skin-engaging surface is less than the width of the rest of the aperture. The dimensions and shape of the apertures in the metal body member are sufficient to allow protruding facial or bodily hairs to enter the aperture, but prevent the skin from entering the aperture so that the cutting blade does not injure the skin. Thus, the apertures should accommodate a human hair follicle, which may be typically approximately 0.02 mm to 0.2 mm in diameter. For example, the distance from the cutting blade to the opposite side of the internal body of the aperture, is suitably from 0.4 mm to 1 mm, for example from 0.4 mm to 0.9 mm, preferably from 0.5 mm to 0.85 mm. The internal width of the main part of the aperture is suitably from 0.6 mm to 2 mm, preferably from 0.8 mm to 1.5 mm. The length of the cutting blade is suitably from 0.6 mm to 2 mm, preferably from 0.9 mm to 1.4 mm.

It is also possible to increase the size of the area adjacent the skin-engaging surface, by forming a cavity at edge of the aperture opposite to the cutting blade, for example by milling. The cavity assists the hair follicle to enter the aperture and helps to present the base of the follicle to the cutting blade, thus increasing the effectiveness and closeness of the shaving process. The presence of a cavity allows the distance between the cutting blade and the opposite edge of the upper area of the aperture adjacent the skin-engaging surface to be suitably from 0.6 mm to 2 mm, for example from 0.8 mm to 1.5 mm, preferably from 0.9 mm to 1.4 mm.

The apertures may be any shape, provided they allow entry of a hair follicle. For example, the shape of each aperture may be circular, hexagonal, triangular, or square. Preferably the apertures are circular.

The apertures may be positioned perpendicular to the skin-engaging surface of the razor, that is, at an angle of 90° to the surface. Alternatively, in a preferred embodiment, the apertures may be positioned at an angle of less than 90° to the skin-engaging surface, for example at an angle of from 50° to 70° to the surface, suitably at an angle of about 60° to the surface. One advantage of providing such angled apertures is that drilling the apertures can produce and angled lip adjacent the skin-engaging surface. The angled lip provides a cutting blade. Thus, the angle of the lip may suitably be from 20° to 40° to the skin-engaging surface, preferably at an angle of about 30° to the surface.

The spacing between each aperture on the body member should be sufficient to retain the rigidity thereof, that is to prevent the body member from being bent or distorted. Suitable spacings between each aperture at the skin-engaging surface are from 0.75 mm to 3 mm, preferably from 1 mm to 2.5 mm. The thickness of the main aperture walls is suitably from 0.1 mm to 1.5 mm, preferably 0.15 mm to 0.75 mm, for example form 0.2 mm to 0.3 mm.

The apertures are generally spaced equidistantly from each other. It is preferred that alternate rows of apertures in the body member are offset from each other to allow the maximum efficiency to capture every hair follicle, as the razor is pulled across the surface of the skin.

With the dimensions of the body member and the apertures described above, the numbers of apertures in the body member may suitably be from 50 to 300, for example from 60 to 250, preferably from 62 to 225.

The cutting blade of each aperture may be formed by drilling the metal body member, and optionally further shaping it, such that edge of the aperture adjacent the skin-engaging surface is sharpened. In order to reduce or prevent burrs on the cutting blade, the body member may be supported on a further piece of metal during the drilling or shaping process. The further piece of metal may suitably be the next body member to be drilled. In that way, guide holes would be produced in the subsequent body member, to aid accurate drilling thereof.

The blade may be shaped by a process called lapping, sometimes referred to as grinding, which involves rubbing the blade against a surface, called a lap, coated with an abrasive such as aluminium oxide, emery, silicon carbide, or diamond. The blade may be then further sharpened. The further sharpening of the cutting blade may be achieved by honing, using a polishing water stone or a diamond stone. Alternatively, the blade may be sharpened and heat-treated by the use of a laser beam.

The body member of the razor may be provided with a slot, or cut-out section in order to assist in holding the body member in a fixed position during the drilling or shaping thereof.

The perimeter of the body member is preferably rounded, in order to avoid any sharp edges which could be used to cause injury.

The body member of the razor of this invention is suitably attached to a handle. To assist in this attachment, the perimeter of the body member is provided with a recess to cooperate with a complementary structure on the handle. For example, the underside of the razor body member may comprise sockets and/or slots, which cooperate with protrusions on the handle. Such an attachment may allow a fixed positioning of the body member onto the handle, or may allow a tilting or rocking mechanism.

The razor of this invention may be disposable and safely discarded after use. Alternatively, the cutting blades within the apertures may be re-sharpened for reuse. However, the sharpening process requires specialist tools that are not available to institutional users, so that adaptation is not possible during normal usage, again reinforcing the harm reduction properties of the razor of this invention.

Although the razor of this invention has particular advantages in harm reduction for institutional users, it also provides a smooth and efficient shaving process. It is therefore also valuable for conventional users in the home. The razor of this invention is suitable for use by men or women and may be used to shave hair from the surface of any part of the body including the face, legs and under the arms.

The foregoing disclosure of specific embodiments is intended to be illustrative of the broad concepts comprehended by the invention.

The invention claimed is:

1. A razor comprising a rigid metal body member having a thickness and a plurality of apertures therein, the rigid metal body member having a skin-engaging surface, wherein each of the apertures is at least partially bounded by a cutting blade with a sharp cutting edge, wherein each of the cutting blades is defined at least partially by the skin-engaging surface, wherein the thickness of the rigid metal body member is from 2 mm to 10 mm, wherein each of the sharp cutting edges is oriented to sever hair introduced to a respective one of the apertures.

2. A razor according to claim 1, wherein the rigid metal body member comprises titanium or steel.

3. A razor according to claim 1, wherein the rigid metal body member comprises stainless steel.

4. A razor according to claim 1, wherein the thickness of the rigid metal body member is from 2 mm to 4 mm.

5. A razor according to claim 1, wherein each of the apertures is circular in cross-section.

6. A razor according to claim 1, wherein each of the apertures defines a longitudinal axis positioned perpendicular to the skin-engaging surface.

7. A razor according to claim 1, wherein each of the apertures defines a longitudinal axis positioned at an angle of from 50° to 70° to the skin-engaging surface.

8. A razor according to claim 1, wherein an internal width of a main part of each of the apertures is from 0.6 mm to 2 mm.

9. A razor according to claim 1, wherein an internal width of a main part of each of the apertures is from 0.8 mm to 1.5 mm.

10. A razor according to claim 1, wherein the rigid metal body member contains from 60 to 250 of the apertures.

11. A razor according to claim 1, wherein the apertures are formed in a plurality of rows in the rigid metal body member and alternate rows of the apertures in the rigid metal body member are offset from each other.

12. A razor according to claim 1, wherein the rigid metal body member is attached to a handle.

* * * * *